US007469682B2

(12) United States Patent
Anderson et al.

(10) Patent No.: US 7,469,682 B2
(45) Date of Patent: Dec. 30, 2008

(54) SUBMERSED FUEL PRESSURE REGULATOR ASSEMBLY

(75) Inventors: Stephen J. Anderson, Livonia, MI (US); Paul F. Briggs, Grand Blanc, MI (US); Jeffery J. Milton, Lake Orion, MI (US); James A. Wynn, Jr., Virginia Beach, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 11/000,650

(22) Filed: Dec. 1, 2004

(65) Prior Publication Data

US 2006/0112938 A1 Jun. 1, 2006

(51) Int. Cl.
*F02M 37/00* (2006.01)
*F02M 69/54* (2006.01)

(52) U.S. Cl. ..... 123/457; 123/514

(58) Field of Classification Search ..... 123/514, 123/457; 137/115.01, 115.03, 508, 510
See application file for complete search history.

(56) References Cited

U.S. PATENT DOCUMENTS 5,004,002 A * 4/1991 Kobayashi ..... 137/39
5,727,529 A * 3/1998 Tuckey ..... 123/514
5,762,101 A 6/1998 Burke et al.
5,873,349 A * 2/1999 Tuckey et al. ..... 123/514
6,123,511 A * 9/2000 Sertier ..... 417/87
6,145,536 A * 11/2000 Gerhard et al. ..... 137/510
6,152,114 A * 11/2000 Kleppner ..... 123/514
6,227,242 B1 * 5/2001 Kleppner ..... 137/574
6,453,884 B2 * 9/2002 Ushigome ..... 123/509
6,681,798 B2 * 1/2004 Bueser et al. ..... 137/539
2003/0094161 A1 * 5/2003 Suzuki et al. ..... 123/509

* cited by examiner

*Primary Examiner*—Thomas N Moulis

(57) ABSTRACT

The present invention refers to a fuel pressure regulator assembly and method for regulating the pressure of the fuel supplied to the fuel rail at a predetermined pressure. The fuel pressure regulator includes a housing and fuel cover for containing the fuel pressure regulator and submersing the fuel pressure regulator in fuel at all times. A valve element allows excess fuel to exit the fuel pressure regulator and return to the fuel tank for reuse. The fuel component assembly also allows for a method of reducing turbulent fuel flow and for controlling noise and hydrocarbon emissions. The method is achieved by providing a containment assembly that submerges the pressure regulator in fuel for containing and directing fuel flow path.

14 Claims, 2 Drawing Sheets

SUBMERSED FUEL PRESSURE REGULATOR ASSEMBLY

FIELD OF THE INVENTION

This invention relates to fuel regulators for combustion engine applications in power automotive vehicles.

BACKGROUND OF THE INVENTION

It is known to mount a fuel pressure regulator on a fuel rail assembly to regulate the pressure of the fuel that is supplied to the fuel injectors mounted on the fuel rail. The pressurized fuel that is delivered to the fuel rail is pumped from a fuel tank through a fuel supply conduit and excess fuel is returned from the fuel pressure regulator's return port through a fuel return conduit to the tank. This type of system is called a return type system. A typical fuel pressure regulator used in this system provides a movable wall or diaphragm dividing the regulator into chambers on opposite sides thereof at different pressures. The difference in pressure determines the position of the diaphragm, which in turn determines the size of a flow passage through the regulator. Thus, depending upon the difference in pressure on opposite sides of the diaphragm, the flow through the regulator is regulated to a predetermined pressure.

Another type of fuel injection system does not have a fuel return conduit and is called a returnless (non-return or dead head) fuel system. In this system, the diaphragm controls the position of a ball valve which is spring-based toward a valve-seat. Fuel flows past the spring and normally opened ball valve into a compartment on one side of the diaphragm for flow to a fuel rail. The opposite side of the diaphragm may have a vacuum reference. It will be appreciated that the difference in pressure between the chambers on the opposite sides of the diaphragm displaces the diaphragm, which in turn mounts a post for moving the ball valve away from the seat or permitting the ball valve to move toward the seat under the spring bias.

Such systems are satisfactory for use in providing fuel to a fuel rail at a predetermined regulated pressure. While such pressure regulators have proven satisfactory, there is a need to maximize performance of the combustion engine to which fuel is supplied from the fuel pressure regulator. A combustion engine should not be supplied fuel that is turbulent or aerated. To avoid turbulent flow and aerated fuel, it is generally desirable to maintain a constant level of fuel within and about the fuel pressure regulator. This requires submersing the fuel pressure regulator in fuel. An added benefit from this is the potential reduction in noise. There has developed a need in the mechanical fuel system for a fuel pressure regulator which provides the desired engine performance for a simple and inexpensive means to keep a fuel pressure regulator submersed in fuel.

SUMMARY OF THE INVENTION

In accordance with one aspect of this invention, a fuel pressure regulator assembly residing in a fuel tank comprising: a containment assembly for submerging a fuel pressure regulator in fuel; a valve element for regulating a fuel pressure and directing excess fuel flow in a fuel system wherein the valve element rests on a valve seat in a closed position to prohibit the fuel flow; and a fuel cover for directing a fuel flow exiting the fuel pressure regulator assembly into the fuel tank.

In accordance with another aspect of this invention, a method for reducing noise and hydrocarbon emissions of fuel in a fuel pressure regulator, the method comprising: providing a containment assembly for containing fuel; regulating fuel pressure in a fuel system wherein a valve element rests on a valve seat in a closed position and the valve element displaces axially off the valve seat in an open position; and submerging the fuel pressure regulator in fuel.

It is an object of the present invention to provide a fuel pressure regulator that reduces the turbulence and aeration of the fuel that flows to the combustion engine.

It is a further object of the present invention to provide a fuel pressure regulator that dampens the noise or vibration of the system.

It is also an object of the present invention to keep the fuel pressure regulator submerged in fuel.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION

Figure 1:
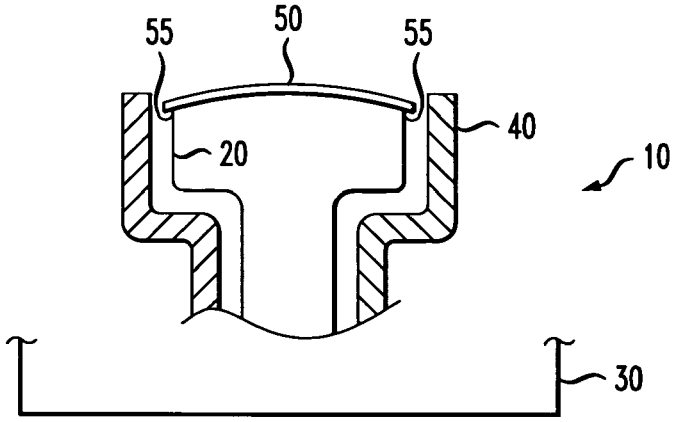
FIG. 1 refers to a cross section view of the fuel pressure regulator according to the present invention.
Figure 2:
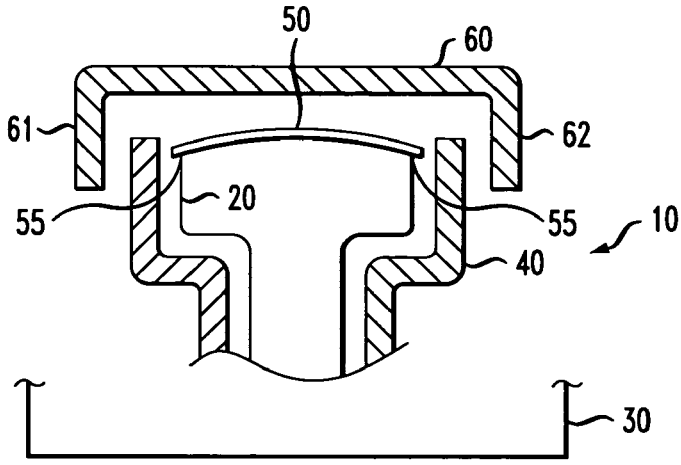
FIG. 2 refers to a cross section view of the fuel pressure regulator with a fuel cover.
Figure 3:
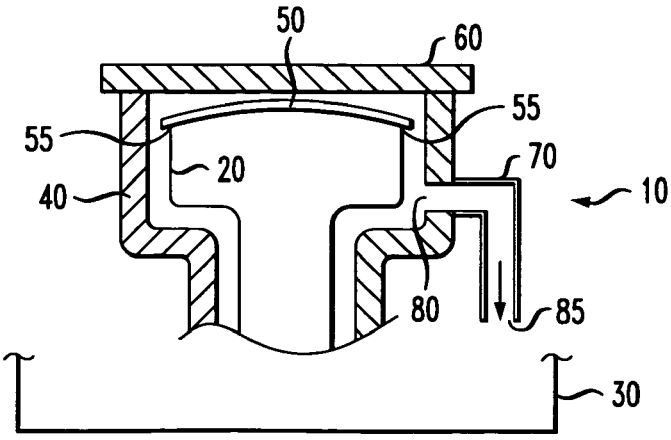
FIG. 3 refers to a cross section view of the fuel pressure regulator with a fuel conduit to the fuel tank.

FIGS. 1-3 refer to various embodiments of the submersed fuel pressure regulator assembly 10 in accordance with the present invention. Each embodiment includes a fuel pressure regulator assembly 10, which comprises a fuel pressure regulator 20 that preferably resides in a fuel tank 30. Fuel tank 30 may be a fuel reservoir (which resides in a fuel tank) or a fuel tank where the fuel pressure regulator assembly 10 is positioned in the line going to the engine on the supply side or in a returnless system where excess fuel is contained in the fuel tank 30 and only consumed fuel is sent to the engine.

As also shown in FIGS. 1-3, each embodiment includes a housing 40 to contain and house the fuel pressure regulator 20. Housing 40 acts as a wall to collect fuel spray released from the fuel pressure regulator 20. The preferred shape of the housing 40 is generally a tubular shape but others skilled in the art may select other shapes including oval, circular, and as necessary for convenient packaging. Likewise, each embodiment includes a valve element 50 disposed on fuel pressure regulator 20, which allows fuel that is at an excess pressure to exit the fuel pressure regulator 20, while retaining fuel not at an excess pressure within fuel pressure regulator 20. The preferred type of valve element 50 may be a convex plate but others skilled in the art may select a flat disk, a biased member, a spring, a ball valve or another equivalent relief-type valve. If the fuel pressure exceeds the desired maximum pressure, the valve element 50 which rests on a valve seat 55 allows excess fuel to exit fuel pressure regulator 20 and the fuel is free to fly out in a variety of directions. Valve seat 55 cooperates with valve element 50 that is movably disposed between an open and closed position. In a closed position, the valve element 50 contacts and seals against the seating surface of the valve seat 55 and prevents fuel flow past the valve seat 55. Pressurized fuel accumulates in fuel regulator 20 until the pressurized fuel contacts the bottom surface of the valve element 50. The pressurized fuel will then push valve element 50 off of valve seat 55 into an open position allowing fuel to flow. Valve element 50 may be a free floating design where it is not retained by other components of the assembly. Others skilled in the art may have a valve element 50 fastened to fuel pressure regulator 20 where the valve element 50 includes an aperture (not shown) or other release mechanism (not shown) to release the pressure and fuel accumulating in the fuel pressure regulator 20. Others skilled in the art may use a hermetic seal, weld, crimp, or clamp to fasten the valve element 50 to the valve seat 55.

A containment means may be utilized to insure that fuel pressure regulator 20 remains submersed in fuel. The expected spray pattern, packaging requirements and other factors will dictate the type and geometry of the containment means utilized in the invention. Three different containment means are described below.

In the first aspect of the invention, which is shown in FIG. 1, the containment means consists of housing 40, which is used to collect the spray of excess fuel exiting the fuel regulator 20. Housing 40 is a cylindrical wall that surrounds fuel regulator 20. The expected spray pattern will dictate the height and geometry of housing 40. In the preferred embodiment, the height of housing 40 will be at least equivalent to the height of valve element 50. Housing 40 is extended and designed to stand in a generally upright position to allow substantially all of fuel regulator 20 to be maintained submersed in fuel. Housing 40 must be extended such that fuel tank 30 allows the fuel pressure regulator 10 to sit in a pocket of fuel at all times. This submersion minimizes or reduces the amount of air from entering the fuel supply system going to the fuel rail and thus minimizes air bubbles forming in the fuel. Similarly, if the spray pattern of fuel is spread in a variety of directions including horizontal and vertical spray for example when a vehicle is idling, then the fuel will break the surface of the collected fuel in regulator 20 and consequently make noise and produce free hydrocarbons thus increasing emissions from the tank 30 by shooting against the components of the fuel pressure regulator assembly 10. Thus a need for a fuel cover 60 would be beneficial in this case.

FIG. 2 refers to an alternate embodiment of the fuel pressure regulator assembly 10 with fuel cover 60. In this embodiment, the fuel cover 60 is not hermetically sealed to the housing 40. Fuel cover 60 comprises extension tabs 61 and 62 to direct the flow of excess fuel back into fuel tank 30.

FIG. 3 refers to an alternative embodiment of the invention whereby fuel pressure regulator 20 is hermetically sealed in a housing 40 by the fuel cover 60. Others skilled in the art may select not to hermetically seal the fuel cover 60 to the housing 40 because any leakage of fuel will return back to the fuel tank 30 and therefore does not pose any problems. In this embodiment, any excess fuel is directed to the bottom of fuel tank 30 using fuel conduit 70. In the preferred embodiment, the inlet 80 of fuel conduit 70 may be positioned near the top of housing 40 such that collected excess fuel may remain above the fuel pressure regulator 20 and then be directed toward the bottom of fuel tank 30. However, there may be other factors (e.g. packaging requirements) that may warrant a different placement of inlet 80. Preferably, outlet 85 should be disposed below a fuel fluid level in the fuel tank 30 to prevent air from entering the fuel pressure regulator assembly 10.

Figure 4:
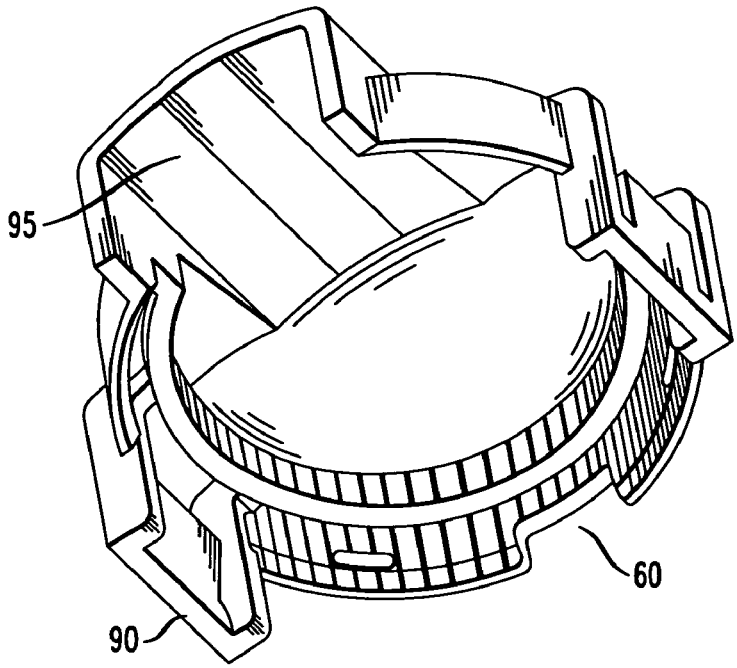
FIG. 4 refers to a perspective view of a fuel cover.

FIG. 4 refers to fuel cover 60. The fuel cover 60 is made of a plastic molded material and also includes at least one snap mechanism 90 allowing ease when being affixed to the housing 40. In the preferred embodiment, the at least one snap mechanism 90 is a tab acting as a clip to hold the fuel pressure regulator 20 in place. One skilled in the art may choose not to affix a fuel cover 60 to the fuel pressure regulator 20. Similarly, others skilled in the art may select to hermetically seal fuel cover 60 to housing 40. Fuel cover 60 also acts to keep the fuel pressure regulator 20 submerged in fuel at all times during fuel flow which enhances durability of the fuel pressure regulator 20 as well as dampen any vibrating noise of the fuel pressure regulator assembly 10. This aids in durability of the spring (not shown) used in the fuel pressure regulator assembly 10. The accumulation of fuel in the chamber below the fuel cover 60 and above valve element 50 functions to keep pressure regulator 20 submerged in fuel. This configuration also protects the other regulator components i.e. flat spring (not shown) from damage during handling, shipping, & assembly. Similarly, submergence of the fuel pressure regulator 20 in the fuel ensures that the fuel is not aerated which maximizes engine performance and that the fuel exits regulator in an organized flow back to the fuel tank 30. Depending on the orientation of the fuel pressure regulator 20 and the fuel cover 60 the fuel cover openings 95 may be facing in a vertical direction which would then allow the flow of fuel to enter from the left and exit on the right. For example, in FIG. 3, those ordinary skilled in the art may rotate the fuel pressure regulator 90° allowing fuel to enter from the side as opposed to the bottom.

Figure 5:
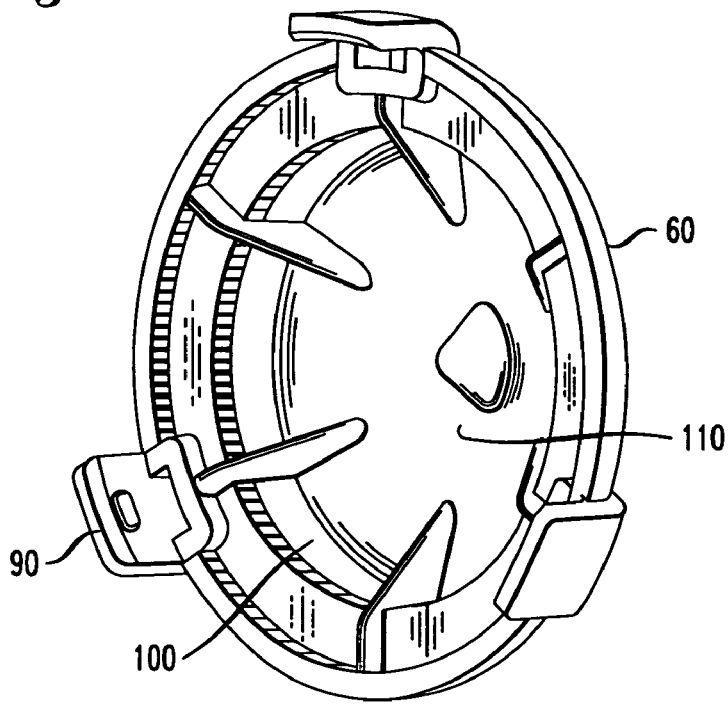
FIG. 5 refers to a perspective view of an alternative embodiment of the fuel cover.

FIG. 5 refers to an alternative embodiment of fuel cover 60. In this embodiment, fuel cover 60 includes as least three snap fit mechanisms 90 to affix the fuel cover 60 to housing 40. Similarly, fuel cover 60 includes a fuel outlet 100 for directing the fuel path from the fuel pressure regulator 20 back to the fuel tank 30. The fuel will hit the top surface 110 of the fuel cover 60 and then exit through side fuel outlet 100 to the fuel tank 30.

While the foregoing description and drawings represent the preferred embodiments of the present invention, it will be apparent to those skilled in the art that various changes and modifications may be made therein without departing from the true spirit and scope of the present invention.

The invention claimed is:

1. A fuel pressure regulator assembly constructed and arranged to reside in a fuel tank comprising:

a containment assembly for submerging a fuel pressure regulator in fuel, the containment assembly having an overall height;

a valve element associated with the fuel pressure regulator for regulating a fuel pressure and directing excess fuel flow in a fuel system wherein the valve element rests on a valve seat in a closed position to prohibit the fuel flow, the valve element having an overall height, the overall height of the containment assembly being substantially equal to the overall height of the valve member; and a fuel cover coupled to the containment assembly and having a closed surface above the valve element, the closed surface being spaced from the valve element in such a manner so as to be contacted by fuel spray that is emitted from the valve element and to direct a fuel flow emitted from the valve element into the fuel tank.

2. The fuel pressure regulator assembly of claim 1, further comprising the fuel cover affixed to a housing for collecting the excess fuel emitted from the valve element of the fuel pressure regulator.

3. The fuel pressure regulator assembly of claim 1, wherein a hermetic seal affixes the fuel cover to the housing.

4. The fuel pressure regulator assembly of claim 1, wherein at least one snap mechanism affixes the fuel cover to the housing.

5. The fuel pressure regulator assembly of claim 1, wherein the fuel cover comprises a fuel outlet for fuel flowing from the fuel pressure regulator to the fuel tank.

6. The fuel pressure regulator assembly of claim 1, wherein the pressure regulator comprises a valve element shaped as one of a spherical convex plate, a flat plate, a sphere, and a truncated sphere.

7. The fuel pressure regulator assembly of claim 1, wherein the valve element is a free floating design.

8. The fuel pressure regulator assembly of claim 1, wherein the valve element displaces axially off the valve seat when in an open position.

9. A method for reducing noise and hydrocarbon emission of fuel in a fuel pressure regulator, the method comprising:

providing a containment assembly for containing fuel, the containment assembly having an overall height;

regulating fuel pressure in a fuel system wherein a valve element of a fuel pressure regulator rests on a valve seat in a closed position and the valve element displaces axially off the valve seat in an open position, the valve element having an overall height, ensuring that the overall height of the containment assembly is substantially equal to the overall height of the valve member;

submerging the fuel pressure regulator in fuel; and providing a cover affixed to the containment assembly and having a closed surface above the valve element, the closed surface being spaced from the valve element in such a manner so as to be contacted by fuel spray that is emitted from the valve element and to direct excess fuel emitted from the valve element of the fuel pressure regulator.

10. The method of claim 9, wherein a hermetic seal affixes the fuel cover to the housing.

11. The method of claim 9, wherein at least one snap mechanism affixes the fuel cover to the housing.

12. The method of claim 9, wherein the fuel cover comprises a fuel outlet for excess fuel flowing from the fuel pressure regulator back to the fuel tank.

13. The method of claim 9, comprising a wall surrounding the fuel pressure regulator and generally positioned upward at a height of at least a height of the valve element for collecting fuel.

14. The method of claim 9, wherein the pressure regulator comprises a valve element shaped as one of a spherical convex plate, a spherical flat plate, a sphere, and a truncated sphere.

* * * * *